United States Patent [19]

Craighead

[11] Patent Number: 4,875,323

[45] Date of Patent: Oct. 24, 1989

[54] PACKAGING MACHINE JAMMING DETECTOR

[75] Inventor: Jimmy R. Craighead, West Monroe, La.

[73] Assignee: Manville Corporation, Denver, Colo.

[21] Appl. No.: 154,669

[22] Filed: Feb. 9, 1988

[51] Int. Cl.[4] ..... B65B 21/08; B65B 57/16

[52] U.S. Cl. ..... 53/48; 53/56; 53/566

[58] Field of Search ..... 53/48, 56, 566, 52

[56] References Cited

U.S. PATENT DOCUMENTS

| | | | |
|---|---|---|---|
| 2,263,501 | 11/1941 | Jones | 53/56 |
| 2,285,283 | 6/1942 | Jones | 53/56 |
| 3,174,259 | 3/1965 | Jones | 53/566 |
| 4,237,673 | 12/1980 | Calvert | 53/48 |

*Primary Examiner*—John Sipos
*Attorney, Agent, or Firm*—John D. Lister

[57] ABSTRACT

Plates mounted on support structure of a machine for packaging articles in sleeve-type carriers act as guides for the moving articles and as detectors of article jams which occur inside open sleeves prior to the closing of the end panel flaps of the sleeves. The plates are mounted for movement toward and away from the moving carrier sleeves and are biased inwardly toward the path of movement of the carrier sleeves. When a jam occurs the pressure of articles moving outwardly of the sleeve causes the plate to pivot away from contact with a sensor, thereby automatically shutting down the machine. The plate extends to the flap closing area so as to detect jams at any point between the loading station and the flap closing station.

18 Claims, 4 Drawing Sheets

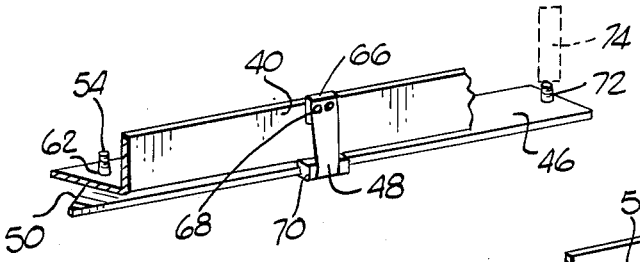
FIG. 7
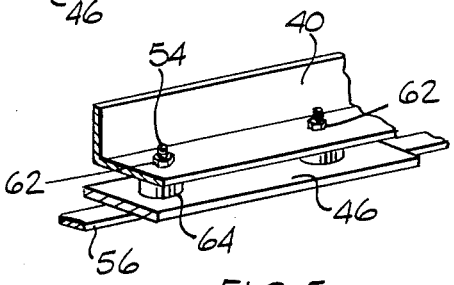
FIG. 5
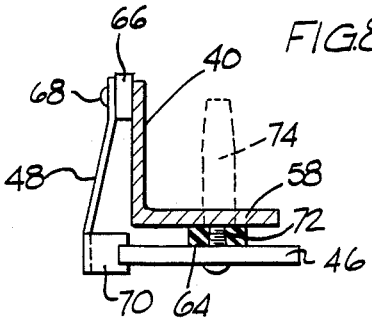
FIG. 8
FIG. 9A
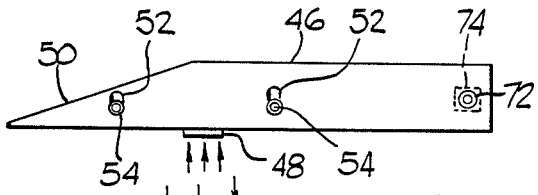
FIG. 9B
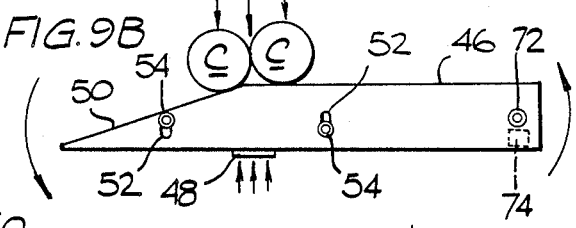
FIG. 6
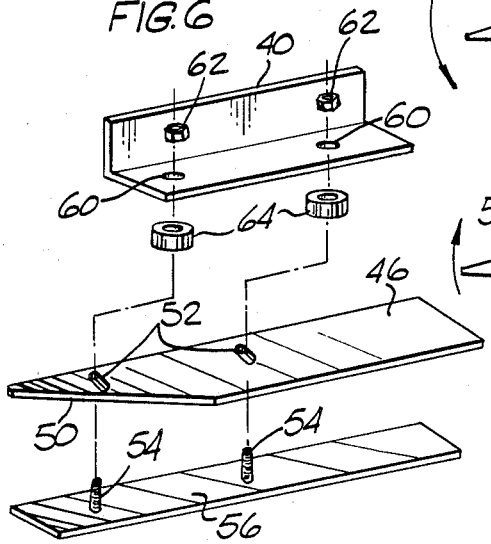
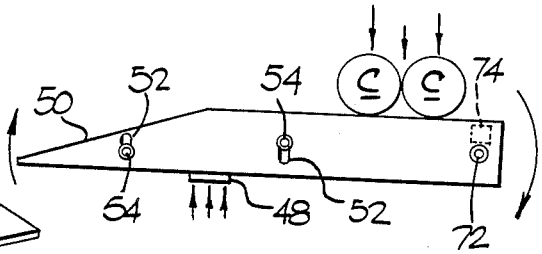
FIG. 9C

PACKAGING MACHINE JAMMING DETECTOR

FIELD OF THE INVENTION

This invention relates generally to the packaging of articles in a sleeve-type carrier. More particularly, it relates to the detection of an article jam in the carrier sleeve before the end panels of the carrier have been closed.

BACKGROUND OF THE INVENTION

In the packaging of articles in sleeve-type carriers the articles are introduced to rapidly moving open-ended carrier sleeves. The articles are loaded through the open ends of the sleeves, after which the end flaps of the sleeves are closed and sealed, resulting in filled completely formed carriers. Typical of this type of operation is the packaging of beverage cans in sleeve-type carriers. The cans are normally pushed downstream in groups of predetermined numbers on opposite sides of moving carrier sleeves and are guided by stationary angled rails to a loading station where the cans enter the opposite open ends of the moving sleeve.

Although machines of this basic design have been used for many years and although many improvements in their design have been made over the years, the cans still occasionally jam together at the loading station as they are being introduced into a carrier sleeve. When this happens the end flaps cannot be closed properly and the cans fall out, requiring the machine to be stopped in order to clear out the loose cans and the carrier sleeve. If the machine is not stopped quickly the cans often remain in the loading area and impede the loading and closing of subsequent carriers as well. Because of the high machine speeds involved a single jam could affect a number of trailing cans and carrier sleeves.

One reason for this occasional jamming problem may be traced to the passage of the cans in the transition area between the ends of the stationary can guides and the open end of the carrier sleeve. Basically the cans are no longer guided in this area because the structural configuration of the machine does not permit the stationary guides to continue into the area. Yet this is where the cans are most vulnerable to being pushed over by other cans and falling, thus creating the jamming situation mentioned above.

It would be desirable to be able to more effectively guide the cans in their travel between the ends of the usual guide rails and the open end of the carrier sleeve in order to reduce the frequency of can jams. It would also be desirable to provide an automatic system for quickly stopping the machine if such a jam occurs.

BRIEF SUMMARY OF THE INVENTION

This invention provides a means mounted on the machine adjacent the path of the open ends of the carrier sleeves, at least a portion of the mounted means extending downstream of the article loading area. The mounted means is positioned so as to be contacted by cans or other articles moving outwardly through one or both of the open ends of the carrier as a result of an article jam inside the carrier sleeve. Preferably the mounted means comprises a horizontal plate the upstream portion of which acts as a guide for the upper portion of the articles after the articles have left the conventional guide rail area of the machine. The plate additionally is mounted for slight movement, preferably about vertical pivot points, in response to outward movement of the cans, which causes a signal to be sent to stop the can and carrier sleeve moving means. The specific design and mounting of the plate allows it to perform both functions of guiding the articles into the carrier sleeves and shutting off the drive when there is a jam.

Other features and aspects of the invention, as well as its various benefits, will be made clear in the more detailed description of the invention which follows.

BRIEF DESCRIPTION OF THE DRAWINGS

FIG. 5 is a pictorial view of the mounted guide and detecting plate, with portions of the plate structure removed in order to expose to view the clamp bar beneath, as it would appear when viewing the far plate assembly installation;

FIG. 6 is an exploded pictorial view of the plate assembly components;

FIG. 7 is a pictorial view of the opposite side of the mounted guide and detecting plate of FIG. 5, but showing the entire support plate;

FIG. 8 is an end elevational view of the mounted plate, with the structural angle on which it is mounted shown in section;

FIG. 9A is a schematic plan view of the plate of this invention in normal position;

FIG. 9B is a view similar to that of FIG. 9A, but showing the movement of the plate in response to outward pressure from an article jam at one location in the article loading station;

FIG. 9C is a view similar to that of FIG. 9B, but showing the movement of the plate in response to outward pressure from an article jam at a different location in the article loading station;

DESCRIPTION OF THE PREFERRED EMBODIMENTS

Figure 1:
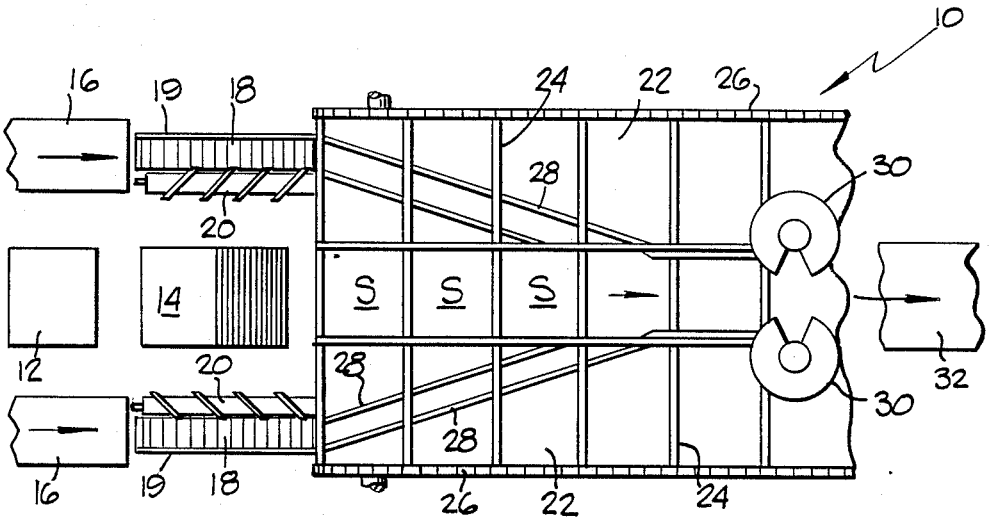
FIG. 1 is a schematic plan view of the packaging machine of the present invention.

Referring to FIG. 1, one form of sleeve-type packaging machine 10 comprises a carton blank hopper 12, a carton blank opening means 14 and article or can infeed conveyors 16. The hopper 12 contains flattened carrier sleeves which are fed by suitable means to the carton blank opening means 14 where the flattened sleeves are erected to form open-ended carrier sleeves. The hopper, blank feed means and blank erecting means may be of any suitable prior art design, the specifics of which do not form part of the present invention.

The infeed conveyors 16 deposit cans onto the delivery conveyors 18, which may be of any practical design but which are illustrated as being comprised of slats connected at their ends to continuous chains 19. The cans can be segregated into groups of the desired number by any convenient means, such as, for example, by screws 20, the design and operation of which are well known in the art.

The opened carrier sleeves S are deposited onto the machine support surface 22 in the pockets or space between adjacent flight bars 24, the ends of which are connected to continuous chains 26. In this manner the flight bars push the sleeves along machine support surface 22 in a downstream direction. The groups of cans are deposited by the conveyors 18 onto the support surface 22 between lower can guides 28, and are also pushed downstream by the flight bars 24. The cans follow the guides 28 which direct them at an angle into a sleeve loading station where the can guides on opposite sides of the carrier sleeves converge. Downstream from the loading station the dust flaps of the carrier sleeves are closed in known manner by the closure wheels 30, and the carriers then progress further downstream where the remaining flaps are closed by folding rails and sealed by adhesive. The finished packages are then moved off the machine for further handling by a discharge conveyor 32.

Figure 2:
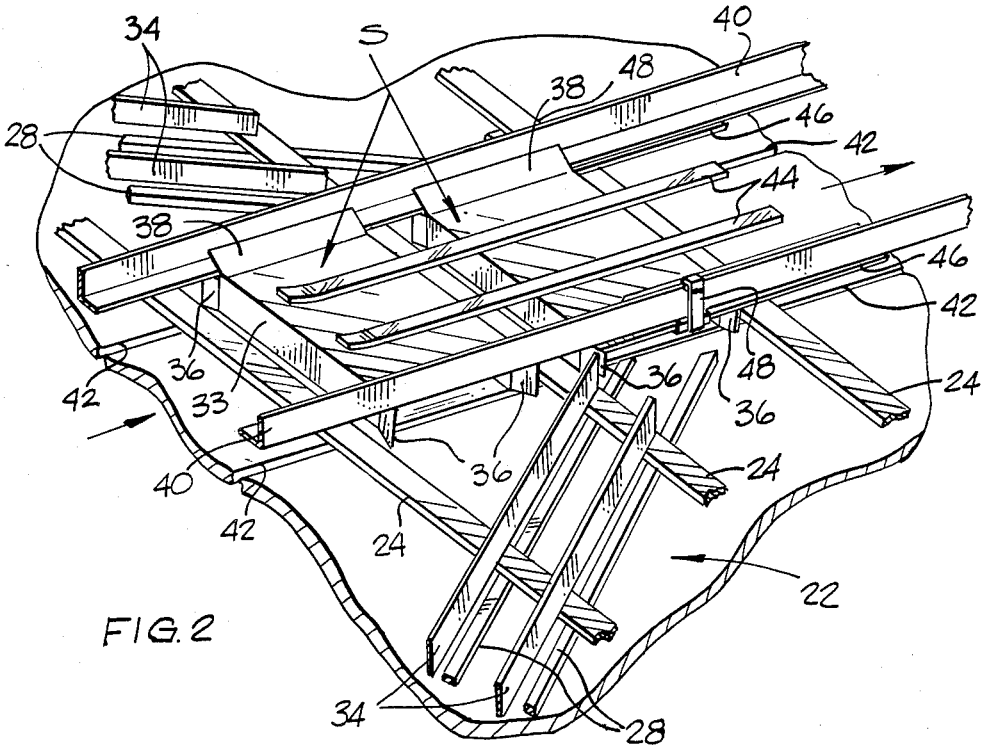
FIG. 2 is a pictorial view of the article loading section of the packaging machine of FIG. 1.

Referring to FIG. 2, the trailing upright panels 33 of the sleeves S are shown being pushed by flight bars 24 to advance the sleeves downstream. The can guides 28, which act as guides for the bottom portions of cans being pushed downstream on support surface 22, are attached to the support surface. Vertically spaced from the guides 28 are guides 34, which may take the form of elongated plates located so as to contact the central or intermediate portion of the cans to prevent them from being pushed over the tops of the low can guides 28. As indicated above, similar can guides are located on both sides of the path of travel of the carrier sleeves, terminating at the can loading station where the flight bars push the cans into the open ends of the carrier sleeves. The intermediate can guides 34 are spaced a distance above the lower can guides 28 to allow the flight bars 24 to move therebetween.

The carrier sleeves S are shown in FIG. 2 with their ends open, with the leading and trailing dust flaps 36 extending outwardly and the upper and lower end flaps 38 being held so as to maintain the ends of the sleeves open. The upper end flaps 38 are held in an upwardly folded position by overhead support angle 40, as best illustrated by the upper end flaps at the far side of the sleeves shown in FIG. 2. The lower end flaps are held in a downwardly folded position by the support surface 22, the lower end flaps extending through a slot 42 in the support surface and not being visible in this view. It should be understood that the support surface 22 need not be a solid surface as shown, but may consist of spaced strips or slats, so long as the surface permits the sleeves and cans to slide over it as the flight bars push them downstream. The tops of the sleeves are shown being held in place by conventional hold-down bars 44. At the point of entry of the cans and extending for a distance downstream from that point is a plate 46 connected to the support angle 40 by means explained in more detail hereinafter. The plate 46 is shown being biased toward the interior of the machine by leaf spring 48 as will also be explained in more detail hereinafter. It will be understood that a similar arrangement is provided on the opposite support angle, the inner edge of the opposite plate 46 being shown in FIG. 2 as extending from beneath the bottom of the support angle 40 just downstream from the sleeve S shown at the far right of FIG. 2.

Figure 3:
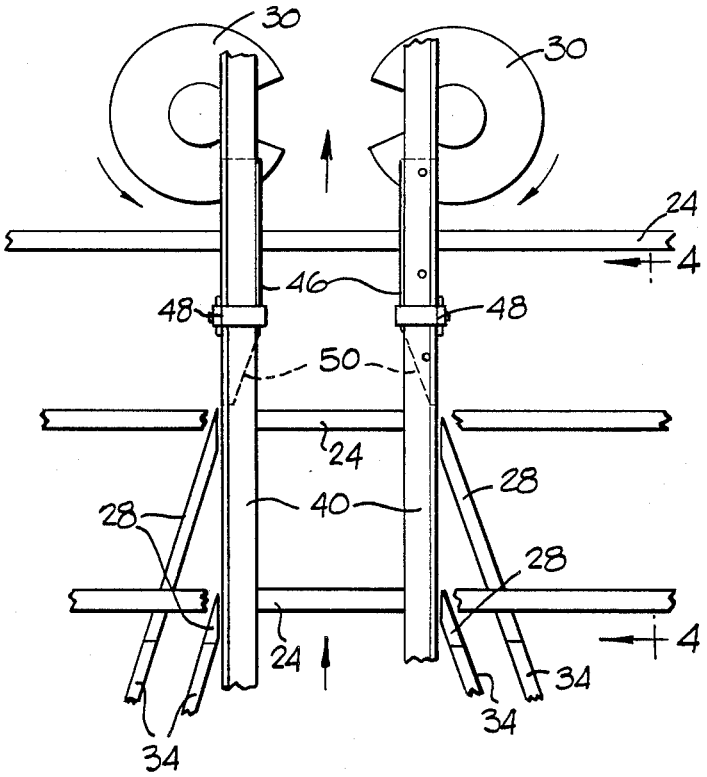
FIG. 3 is a plan view of the article loading area of FIG. 2, with some of the structure of the machine omitted for purpose of clarity.

The can loading area and the plate arrangement are also shown in FIG. 3, which illustrates the location of the plates 46 with respect to the can guides 28 and 34 and omits the sleeves and cans for purpose of clarity. In this view it can be seen that the upstream edge 50 of each plate, shown in dotted lines because it is hidden by the associated support angle 40, is angled so as to be substantially aligned with the can-engaging surface of the outer intermediate can guides 34. Thus the edge 50 is aligned with the path of travel of the upper outer portion of the cans C as they leave the guides 28 and 34 and pass beneath the support angles to the open carrier sleeve ends. In this way the cans continue to be guided over this transition area, which previously was left to the cans to traverse alone with no guiding assistance.

Figure 4:
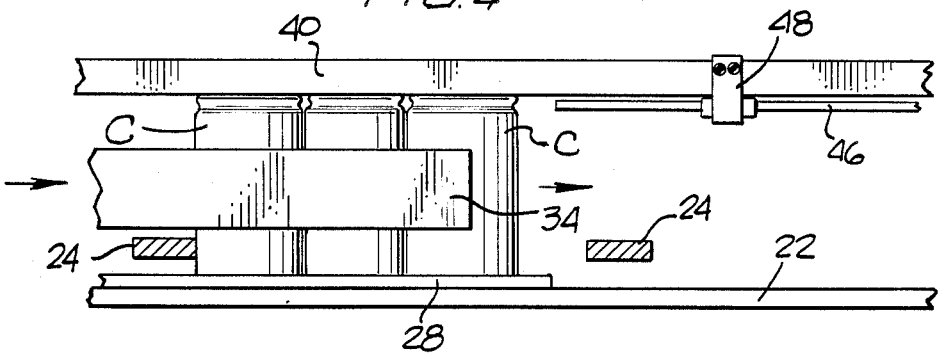
FIG. 4 is a side elevational view of the article loading section of FIGS. 2 and 3, taken on line 4—4 of FIG. 3, with the flight bar being shown in section.

Note that the plates 46 extend downstream a substantial distance, terminating just upstream from the flap closing wheels 30. The plates are thus able to detect any jamming situation which occurs between the can loading station and the flap closing station. As shown in FIG. 4, the upstream end of the guide plate 46 begins at substantially the point at which the downstream end of the lower guides 28 and the intermediate guides 34 terminate. It should be understood that the guide plate 46 is located so as to contact the upper portion of the cans C regardless of the specific contour of the cans. Therefore, even if the top portions of the cans are of slightly reduced diameter as illustrated in FIG. 4 and consequently are not, strictly speaking, vertically aligned with the rest of the can side wall, the plate would be positioned accordingly so that the angled edge 50 shown in FIG. 3 contacts the reduced diameter portion of the cans.

The components of the guide plate assembly are best illustrated in FIGS. 5 and 6, wherein it can be seen that the plate 46 is provided with spaced slots 52. Extending upwardly through the slots 52 are pins or shafts 54 connected to clamp bar 56. The slots 52 extend transversely of the length of the plate a distance greater than the diameter of the pins 54 to permit relative movement between the pins and the plate 46 as explained in more detail below. The horizontal leg 58 of angle support 40 contains holes 60 for receiving the pins or shafts 54, and nuts 62 connected to the threaded ends of the shafts 54 hold the assembly together. Bushings 64 preferably surround the pins 54 between the underside of the angle support leg 58 and the upper face of the plate 46 to permit easier relative movement between the plate 46 and the fixed clamp bar 56 and angle support 40.

Referring to FIGS. 7 and 8, attached to the outer face of the vertical leg of angle 40 is a spring mount 66 to which leaf spring 48 is attached, as by screws 68. The lower end of the leaf spring fits in an outwardly facing recess in spring guide 70, which is notched on its inner face to provide a recess for receiving the outer edge of the plate 46. The leaf spring is connected to the plate 46 at a point located between the two pins 54 to enable the plate to detect jamming of cans as explained below. Extending up from the downstream portion of the plate 46 is a sensing screw 72 and extending down from the machine structure is a sensor 74. Although a screw is preferred as one of the contacts to allow the contact to be adjusted, obviously the sensor element or other contact member can be made adjustable instead. Any desired circuitry can be used for the detection circuit, so long as movement of the sensing screw 72 away from or out of contact with the sensor 74 sends a signal which shuts down the flight bar drive. Such a signal could obviously be sent as a result of either closing or opening a circuit when the sensing screw is moved from its normal operating position.

In operation, cans delivered to the loading station at the downstream end of the can guides 28 and 34 are guided at their upper portions by the angled upstream edge 50 of the plate 46, assisting the movement of the cans over this transition area as they move into the open ends of the moving carrier sleeve at the loading station. The cans are thus better stabilized in this critical area and are less likely to fall and create a jamming situation. Under normal nonjamming operating conditions the plate would remain in its operative guiding position, with the leaf spring 48 urging the plate inwardly toward the moving carrier sleeves. This condition is illustrated schematically in FIG. 9A, which shows the plate at the right side of the machine, wherein the arrows adjacent the leaf spring 48 indicate the direction of the force exerted by the spring, causing the outer ends of the slots 52 to push against the pins 54. Since the force exerted by the cans moving against the plate edge 50 is not nearly enough to overcome the force of the spring 48, the plate remains in this state during normal operation, and the sensing screw 72 remains in contact with the sensor element 74.

If, despite the beneficial effect of the plate guiding surfaces 50, a can falls in the loading area and creates a jam, the predetermined number of cans introduced to the carrier sleeve being loaded will not be able to fit within the confines of the sleeve since the cans ordinarily can fit properly only if all the cans are in their upright side-to- side condition. As a result, one or more of the cans inside the sleeve will be moved outwardly against the inner edge of one or both of the plates 46. If the cans are pushed outwardly against the inner edge of the plate at a point between the pins 54, as shown in FIG. 9B, with a force sufficient to overcome the force of the leaf spring 48, the upstream end of the plate will be pushed outwardly until the inner end of the upstream slot 52 engages the upstream pin 54. Under such conditions the force of the spring is enough to maintain the outer end of the downstream slot 52 in contact with the downstream pin 54, causing the plate to pivot about the downstream pin. When this happens the sensing screw 72 moves out of contact with the sensor element 74, and the circuit controlling the flight bar conveyor drive shuts off the drive.

FIG. 9C illustrates the other jamming condition. When the cans in the carrier sleeve are pushed outwardly against the inner edge of the plate 46 at a location downstream of the downstream pin 54, the force is enough to overcome the inward force of the leaf spring to the extent that the downstream end of the plate is moved until the inner end of the downstream slot 54 engages the downstream pin 52. The force of the leaf spring when this occurs is still enough to maintain contact between the upstream pin and slot as shown in FIG. 9A. The plate 46 under these conditions pivots about the upstream pin 52, and the sensing screw 72 moves away from the carrier sleeves and out of contact with the sensor element 74, once again resulting in the flight bar conveyor drive being shut off.

Figure 10:
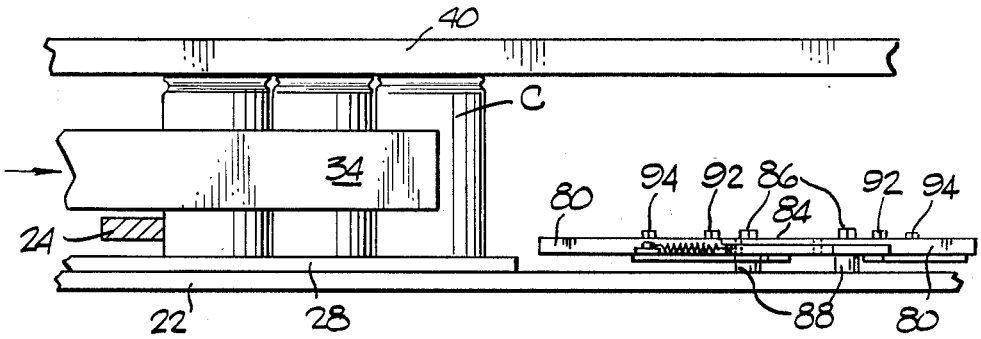
FIG. 10 is a view similar to that of FIG. 3, but showing a modified jam detecting plate.

Referring to FIG. 10, another embodiment of the invention is shown in a view similar to that of FIG. 4, wherein like reference numerals denote similar elements. In this arrangement, as in the arrangement of FIG. 4, cans C are pushed downstream by flight bar 24 and are guided in their movement by lower guides 28 and intermediate guides 34. Instead of providing a jam detector plate connected to the support angle 40 adjacent the uppermost path of can movement, however, a detector plate 80 is provided adjacent the support surface 22.

Figure 11:
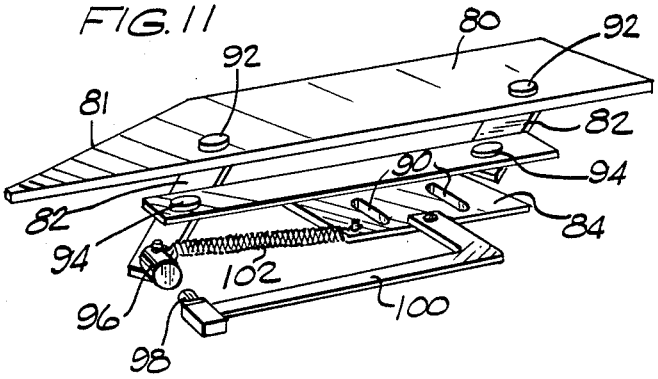
FIG. 11 is a pictorial view of the modified jam detecting plate assembly.

As shown in FIGS. 10 and 11, the detector plate 80 has a sloped or angled side edge 81 adapted to be located so as to guide the outer edges of cans moving into the carrier sleeve loading area of the machine. This edge would thus provide a similar function to the edge 50 of the first embodiment. The plate is connected by two links 82 to a stationary support plate 84 which is connected by any suitable means, such as by bolts 86, to the support 22. The plate 84 may be adjusted to the proper height by spacers 88, and may be provided with slots 90 for receiving the bolts. The links 82 are pivotally connected to the detector plate 80 by pins 92 and to the support plate 84 by pins 94. The upstream link 82 supports a sensor 96 which under normal operating conditions is in contact with sensing screw 98. The sensing screw 98 is mounted on an angled support arm 100 extending from the support plate 84 so as to be in the proper position for contact with the sensor 96. A coil spring 102 biases the sensor 96 into contact with the sensing screw 98.

Figure 12A:
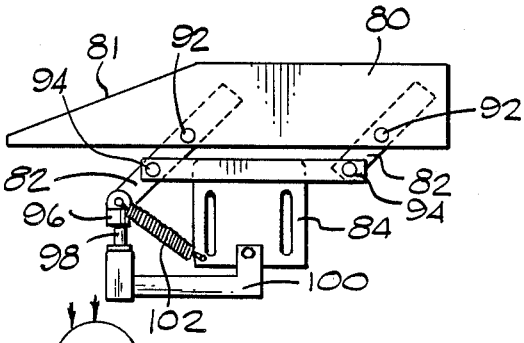
FIG. 12A is a schematic plan view of the modified plate in normal position.
Figure 12B:
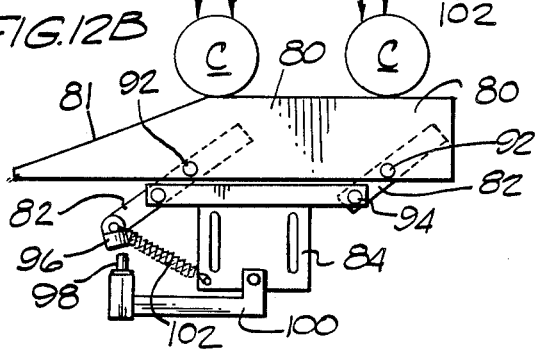
FIG. 12B is a view similar to that of FIG. 12A, but showing the movement of the plate in response to outward pressure from an article jam in the article loading station.

The operation of the detecting mechanism is depicted in FIGS. 12A and 12B. In FIG. 12A the mechanism is shown in it normal operating condition wherein the detector plate 80 is spaced a predetermined distance from the support plate 84 and the sensor 96 is in contact with the sensing screw 98. If a jam occurs the pressure of the cans against the inner edge of the detector plate will cause the plate to move toward the support plate 85 and disrupt the sensing circuit, causing the carrier sleeve feed and the can feed to halt. As can be seen in FIG. 12B, can pressure at any point along the inner surface of the detector plate 80 will cause the links 82 to pivot the detector plate toward the support plate thereby pivoting the sensor 96 away from the sensing screw 98 against the bias of the spring 102. When the can pressure is removed the spring returns the sensing elements back into contact, swinging the upstream link 82 back to its original position, which thereby returns the detector plate to its original position.

This embodiment can therefore be used if a top-mounted detector plate is impractical or if the major jamming problem requires additional guiding of the bottom portions of the cans more than the top portions. Although making use of the same principles of operation as the first embodiment, this arrangement is specifically different in design so as to enable installation in a different area of the machine where space requirements and support structure availability are different.

It should now be apparent that the can guide and can jam detecting plate assembly of the present invention provides the dual function of guiding cans over the transition area between the ends of the usual type of can guides and the open ends of the carrier sleeve, and also acts to automatically shut off the flight bar conveyor drive and the can conveyor drive when a jam occurs.

This is done in a very simple and economical manner which is nonetheless quite efficient. By using two pivot points and a spring biasing force, the plate can respond quickly to outwardly directed can pressure occurring at any point in the carrier sleeve and yet permit the can guiding edge of the plate to absorb the normal operating can pressure to which it is exposed without causing premature triggering of the conveyor drive circuit.

It should be obvious that although preferred embodiments of the invention have been disclosed, changes to certain of the specific features of the embodiments may be made without changing the overall operation of the jamming detector and without departing from the spirit and scope of the invention as defined in the claim.

What is claimed is:

1. In a machine for packaging articles in a sleeve-type carrier;

means for moving open-ended carrier sleeves downstream of the machine;

article loading means comprising means for moving a plurality of articles into each carrier sleeve through the opposite open ends thereof; and means separate and downstream from said article loading means actuated by articles being forced outwardly through an open end of a carrier sleeve for automatically detecting an article jam inside the carrier sleeve and stopping the operation of the machine.

2. In a machine for packaging articles in a sleeve-type carrier:

means for moving open-ended carrier sleeves downstream of the machine;

article loading means comprising means for moving articles into the carrier sleeves through the open ends thereof; and means for automatically detecting an article jam inside a sleeve carrier and stopping the operation of the machine, comprising means mounted on the machine adjacent the path of movement of the open ends of the carrier sleeves, at least a portion of said mounted means extending downstream from the article loading means, said mounted means being positioned so as to be contacted by articles being forced outwardly through an open end of the carrier sleeve as a result of an article jam inside a carrier sleeve, said mounted means being mounted for movement when contacted by such outwardly forced articles, such movement causing the operation of the machine to stop.

3. A packaging machine according to claim 2, wherein the mounted means comprises at least one plate extending generally horizontally in a plane which intersects at least a portion of the articles inside a carrier sleeve.

4. A packaging machine according to claim 3, wherein the upstream portion of the plate includes a side edge extending upstream from the area of entry of the articles into the open end of a sleeve, said side edge being aligned with the path of movement of the outer sides of the articles as they move toward the point of entry to guide the articles into the open sleeve.

5. A packaging machine according to claim 4, including additionally stationary guide means for guiding the articles, the side edge of the upstream portion of the plate being generally vertically aligned with the stationary guide means.

6. A packaging means according to claim 5, including additionally flight bars for moving both the carrier sleeves and the articles downstream of the machine.

7. A packaging machine according to claim 4, including additionally sensor means, and means associated with the plate for either making or breaking contact with the sensor means to discontinue operation of the machine, said plate associated means including means for biasing the plate toward its normal operating position.

8. A packaging machine according to claim 7, wherein there are two plates, each with a side edge extending upstream from the area of entry of the articles into the opposite open ends of a sleeve.

9. A packaging machine according to claim 7, including additionally means pivotally mounting the plate for movement about a vertical axis.

10. A packaging machine according to claim 9, wherein the means pivotally mounting the plate comprises two vertical shafts extending through slots in the plate, one set of shafts and slots being spaced downstream from the other shaft and slot, the slots in the plate permitting the plate to move toward and away from the carrier sleeves, the force exerted by the biasing means being such that when an article jam produces outwardly directed forces against the plate in a region upstream from the downstream shaft and slot, the plate will pivot about the downstream shaft to either make or break contact with the sensor, and when an article jam produces outwardly directed forces against the plate in a region downstream of the downstream shaft and slot, the plate will pivot about the upstream shaft to either make or break contact with the sensor.

11. A packaging machine according to claim 10, wherein the biasing means comprises spring means biasing the plate toward the path of movement of the carrier sleeves.

12. A packaging machine according to claim 11, wherein the spring means comprises a leaf spring contacting the plate between the two sets of shafts and slots.

13. A packaging machine according to claim 9, wherein the plate is connected to machine support structure located above the path of travel of the articles.

14. A packaging machine according to claim 9, wherein the means pivotally mounting the plate comprises two links pivotally connecting the plate to a fixed support, pivotal movement of the plate moving the plate away from the path of movement of the carrier sleeves.

15. A packaging machine according to claim 14, wherein the biasing means is connected to one of the links.

16. A packaging machine according to claim 15, wherein an element of the sensor means is carried by the link to which the biasing means is connected.

17. A packaging machine according to claim 16, wherein the biasing means is a tension spring connecting the link to stationary support structure.

18. A packaging machine acording to claim 9, wherein the plate is connected to machine support structure located adjacent the bottoms of the articles being loaded.

* * * * *